US008262039B2

(12) United States Patent
Royka

(10) Patent No.: US 8,262,039 B2
(45) Date of Patent: Sep. 11, 2012

(54) TABLEWARE AND TABLE COVER FASTENING SYSTEMS AND METHODS

(76) Inventor: Ed Royka, Oceanside, CA (US)

( * ) Notice: Subject to any disclaimer, the term of this patent is extended or adjusted under 35 U.S.C. 154(b) by 373 days.

(21) Appl. No.: 12/574,467

(22) Filed: Oct. 6, 2009

(65) Prior Publication Data

US 2010/0154683 A1 Jun. 24, 2010

Related U.S. Application Data

(60) Provisional application No. 61/140,416, filed on Dec. 23, 2008.

(51) Int. Cl.
*F16B 47/00* (2006.01)

(52) U.S. Cl. ..... 248/205.3

(58) Field of Classification Search ..... 248/205.3; 220/737, 738, 574, 23.87; 211/41.9; 108/28
See application file for complete search history.

(56) References Cited

U.S. PATENT DOCUMENTS

| | | | | |
|---|---|---|---|---|
| 2,206,694 | A | 7/1940 | Greene | |
| 3,847,324 | A | 11/1974 | Uchanski et al. | |
| 3,939,976 | A | 2/1976 | VanIseghem, Jr. | |
| 4,158,905 | A * | 6/1979 | O'Leary | 24/530 |
| 4,596,370 | A | 6/1986 | Adkins | |
| 4,634,089 | A | 1/1987 | Wright et al. | |
| 4,947,526 | A * | 8/1990 | Fogelman | 24/336 |
| 5,018,695 | A | 5/1991 | Bishop | |
| D318,971 | S | 8/1991 | Mitchell | |
| 5,084,321 | A | 1/1992 | Sui | |
| 5,154,380 | A | 10/1992 | Risca | |
| 5,181,555 | A | 1/1993 | Chruniak | |
| 5,255,818 | A | 10/1993 | Zeigler | |
| 5,384,938 | A | 1/1995 | Frederick | |
| D375,229 | S | 11/1996 | DiBella | |
| 5,873,486 | A * | 2/1999 | Morgan | 220/739 |
| D409,049 | S | 5/1999 | Millard | |
| 5,934,016 | A * | 8/1999 | Jones | 47/41.01 |
| 6,264,026 | B1 * | 7/2001 | Bradley | 206/217 |
| 6,508,183 | B2 | 1/2003 | Kerrigan | |
| 7,207,459 | B1 * | 4/2007 | Latvis et al. | 220/574 |
| 7,743,934 | B2 * | 6/2010 | Martin | 220/23.4 |
| 2005/0056690 | A1 | 3/2005 | Clapper | |
| 2007/0029331 | A1 * | 2/2007 | George et al. | 220/574 |
| 2007/0205205 | A1 * | 9/2007 | Kliewer | 220/737 |
| 2008/0156811 | A1 * | 7/2008 | Lu et al. | 220/574 |
| 2010/0108703 | A1 * | 5/2010 | French | 220/737 |

* cited by examiner

*Primary Examiner* — Ramon Ramirez
(74) *Attorney, Agent, or Firm* — Fish & Associates, PC

(57) ABSTRACT

Paper or plastic cups, plates, and paper utensils are held in place on a table attaching a table cloth to a table, and then attaching by tableware holders to the table cloth. The table cloth and the tableware holders have mating fasteners that prevent the tableware holders from moving relative to the table cloth. Each tableware holder is sized and dimensioned to receive different types of tableware and each holder has stabilizers that prevent the tableware from blowing off of the table.

16 Claims, 3 Drawing Sheets

FIG. 1
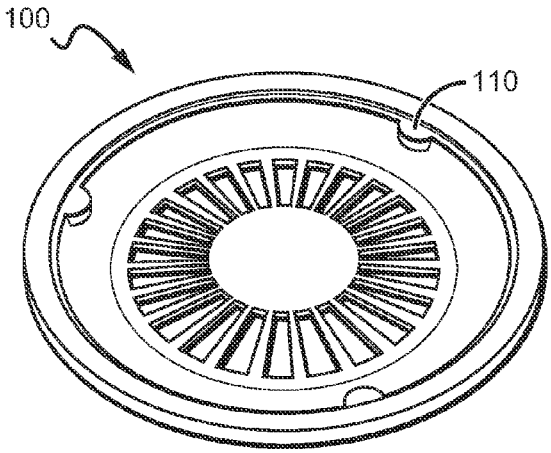
FIG. 2A
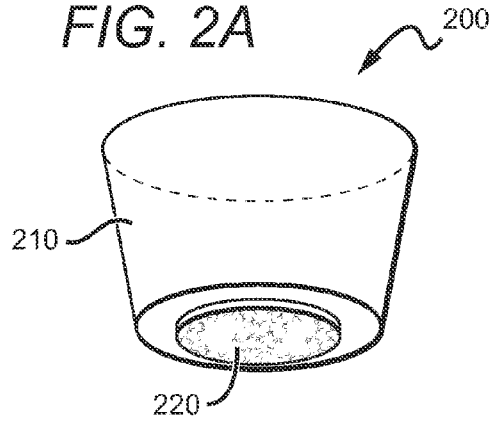
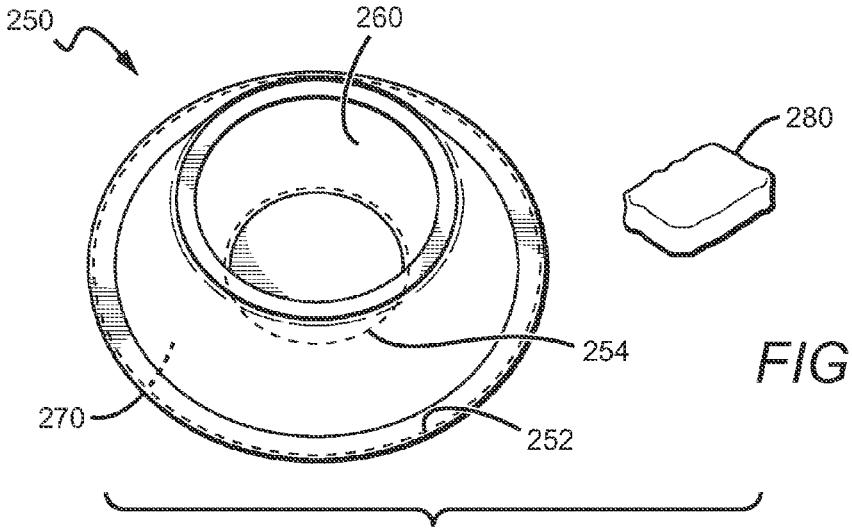
FIG. 2B

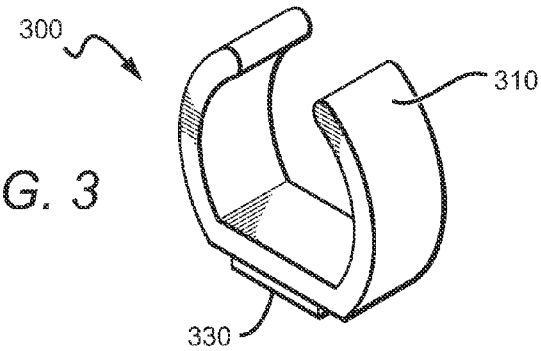
FIG. 3
FIG. 4
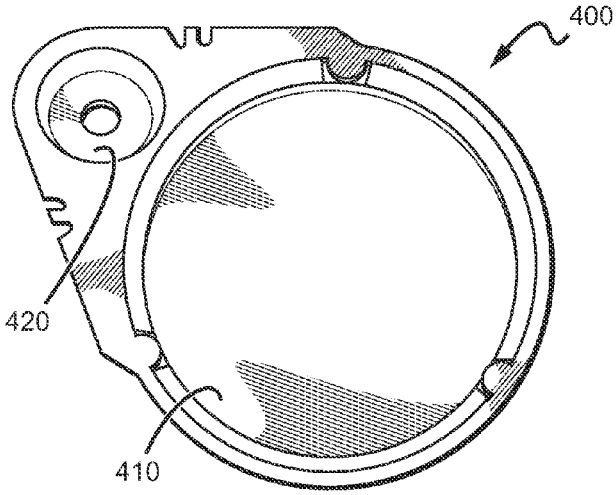
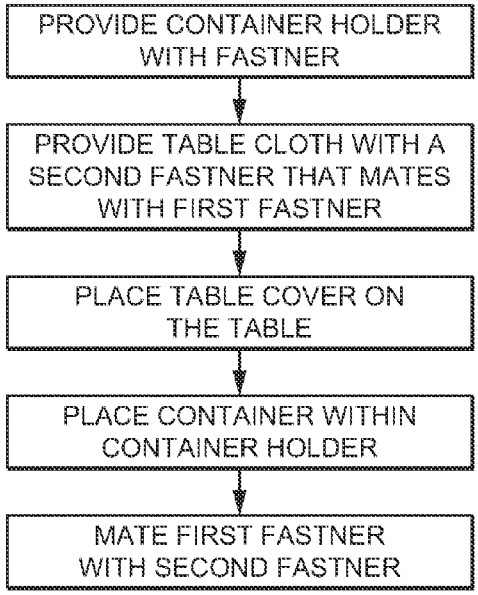
FIG. 6

TABLEWARE AND TABLE COVER FASTENING SYSTEMS AND METHODS

This application claims the benefit of priority to U.S. provisional application having Ser. No. 61/140,416 filed on Dec. 23, 2008. This and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

FIELD OF THE INVENTION

The field of the invention is tableware and table covers.

BACKGROUND

When eating with non-heavy tableware, for example paper plates, bowls, cups, and cutlery, a light breeze can frequently displace or even blow away the tableware. Tableware frequently needs to be temporarily immobilized during outdoor use. U.S. Pat. No. 3,847,324 to Uchanski describes a cup holder with a double-sided adhesive material that temporarily immobilizes the cup holder against a surface. However, Uchanski tends to leave an adhesive residue on any surface that the cup holder is placed against, and the adhesive on the cup holder loses efficacy after repeated use. Uchanski, and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

U.S. Pat. No. 5,154,380 to Risca teaches a cup holder with a Velcro™ fastener on the base that helps to fasten the cup holder to an automobile or a boat. However, this then requires that a matching Velcro™ fastener be adhesively coupled to the automobile or the boat. Many users do not want a Velcro™ fastener to be permanently coupled to the surface of their eating surface.

U.S. Pat. No. 5,384,938 to Frederick teaches a table cloth clip that fastens a table cloth to a table and also has a fastening element that attaches to dinnerware. However, having a long table cloth clip that extends across the table to a plate is unattractive. Frederick's plate also tips from side to side as the plate will tend to rock from one side of the table cover clip to the other, causing an uncomfortable eating experience.

U.S. Pat. No. 6,508,183 to Kerrigan teaches a table cloth with pockets to hold food utensils that hang over the sides of the table cover. While Kerrigan's table cloth is useful for shielding utensils from the wind, Kerrigan's table cloth is impractical when it comes to immobilizing plates, bowls, and cups that need to sit on the surface of the table cloth.

Thus, there is still a need in the art for systems and methods that immobilize tableware relative to a surface.

SUMMARY OF THE INVENTION

The present inventive subject matter is drawn to systems, configurations, and methods of holding a piece of tableware in place on a surface. A preferred means is by disposing a table cover on the surface and fastening a tableware holder to the table cover. As used herein, "tableware" includes any drinking vessels, eating vessels, and utensils that are used to set a table for eating a meal, for example plates, bowls, cups, mugs, glasses, forks, knives, spoons, chopsticks, and napkins.

As used herein, a "tableware holder" is any device that is sized and dimensioned to receive the tableware in a cavity.

The tableware holder preferably has one or more stabilizers that prevent a piece of tableware from moving in one more directions. For example, one or more stabilizer tabs could hang over a cavity to prevent a piece of tableware from moving upwards once the piece of tableware is disposed behind the tab, or one or more stabilizers could surround a piece of tableware to prevent the tableware from moving from side to side. In an exemplary embodiment, a stabilizer composes a wall that wraps around at least two sides of a piece of tableware to prevent the piece of tableware from moving in two substantially different directions. In another embodiment, the stabilizer mates with the piece of tableware, for example by using a suction cup to create a vacuum seal between the piece of tableware and the tableware holder, or by matching an indent/detent formed in the piece of tableware. While the stabilizer and the tableware holder are preferably made from one contiguous piece, the stabilizer and the tableware holder could be made from separate pieces.

The tableware holder could be pre-chilled or pre-heated in order to raise or lower the temperature of the tableware, or of food or drinks. For example, a cup holder could be placed in the freezer to keep drinks cold, or a plate holder could have a heat pack that keeps food on the plate warm. Preferably, the tableware holder has a material with a high specific heat, for example a specific heat that is at least 0.5, 1, 2, 3, or even 4 Joules per gram. In this instance, and where other upper limits are not expressly stated, the reader should infer a reasonable upper limit. In this instance, for example, a commercially reasonable upper limit is about 10 Joules per gram. As used herein, all measurements of specific heat refer to the number of joules required to raise the temperature of a gram the material by one Kelvin.

In an exemplary embodiment, the tableware holder comprises a first material that wraps around the tableware, and a second material with a high specific heat that is separable from the tableware holder. The material could be placed within the tableware holder in a cavity, but preferably mates to a surface of the tableware holder to maximize heat transfer between the tableware holder and the temperature material. The material could be disposed on or within the tableware holder to alter the overall temperature of the tableware holder, or could be used to alter only a portion of the tableware holder. While the material could be provided and sold with the tableware holder, for example an ice pack filled with refrigerant material or a chemical heating pad, but could also be packaged and sold separately from the tableware holder.

Alternatively, the tableware holder could be made of an insulating material that prevents the tableware from losing heat or from gaining heat. The insulating material could be embedded in the floor and walls of the tableware holder, or could be added to the tableware holder as an added accessory.

In a preferred embodiment, the tableware holder also has a first fastener that mates with a second fastener on holds the tableware holder against a table cover. The mating fasteners temporarily immobilize the tableware holder with respect to the table cover, which will in effect immobilize any tableware held by the tableware holder. While the first fastener and the second fastener preferably mate to one another using Velcro™-like hooks and loops, any suitable commercially available fastener could be used, for example adhesives, magnets, snap buttons, and matching detents/indents, threaded screws and threaded holes, zippers, buckles, clasps, clips, grommets, retaining rings, and pins. Where the first fastener is a hook or a loop, the first fastener preferably covers over 80% or over 90% of a surface of the tableware holder, and preferably has a surface area of at least 3 square inches (about 19 square centimeters).

The table cover could have indicators that show where tableware holders should be positioned on the table cover to correctly align with fasteners. For example, a table cover could have entire tableware sets with dotted lines showing locations around the table where a plate holder, a cup older, a utensil holder, and a napkin holder would be placed around the table. Preferably, the substantial portion of one side of the table cover comprises loops that are soft but tough. Has used herein, a "substantial portion" means at least 90% of the top side of the table cover, although at least 70%, at least 80%, or at least 95% of the table cover could comprise loops without departing from the scope of the invention. In this embodiment, multiple tableware holders with hook fasteners could mate with any portion of the table cover. In an exemplary embodiment, the entire table cover is made of a cloth material, for example polyester fiber cloth, that comprises loops.

Preferably the table cover is preferably coupled or fastened to the surface of a table in some manner. Any suitable coupling mechanism could be used, for example by using clips that compress the table cover against the surface, using strings that tie the table cover to table legs, or by merely adding weights to the corners of the table cover to hold it down. Preferably, the coupling mechanisms are located underneath the surface table cloth or to the sides of the table cloth so as to be substantially visually hidden from the top of the table cloth. In an exemplary embodiment, the table cover has small slits in the cover that allow clamps to fit inside the slits and clamp the table cover to the table without being visible from above.

Preferably the table cover and the tableware holders are both provided to a customer in a single sales kit, although tableware holders could be sold separately from the table covers, especially in situations where customers may want to select table covers of different designs. Other related picnic supplies could also be sold in the sales kit, for example table fasteners for coupling the table cover to the table, hot or cold gel packs for heating or cooling the tableware holders, or Velcro™ holiday designs for decorating the table cover for different occasions.

In an alternative embodiment, the tableware holder could have a weight that holds down the tableware holder against the table cover. The weight could compose the material of the tableware holder itself, or could be added to the tableware holder as a separate component that couples with the tableware holder. For example, the tableware holder could have a cavity that accepts a weight. Preferably the weight is over 0.2 kilograms, but could be over 0.5, 0.7, 1.0, or over 2 kilograms without departing from the scope of the present invention. Where the tableware holder comprises a weight over 0.5 kilograms, fasteners may not be needed to couple tableware holders to the table cover.

BRIEF DESCRIPTION OF THE DRAWING

FIG. 1 is a front perspective view of a tableware holder designed to hold a plate.

FIGS. 2A and 2B are side perspective views of alternate tableware holders designed to a hold cup.

FIG. 3 is a side perspective view of yet another alternate tableware holder designed to hold utensils.

FIG. 4 is a side perspective view of a table cover with a cup and the cup holder of FIG. 2.

FIG. 6 is a top perspective view of a tableware holder designed to hold a plate and a cup.

DETAILED DESCRIPTION OF THE DRAWINGS

Figure 5:
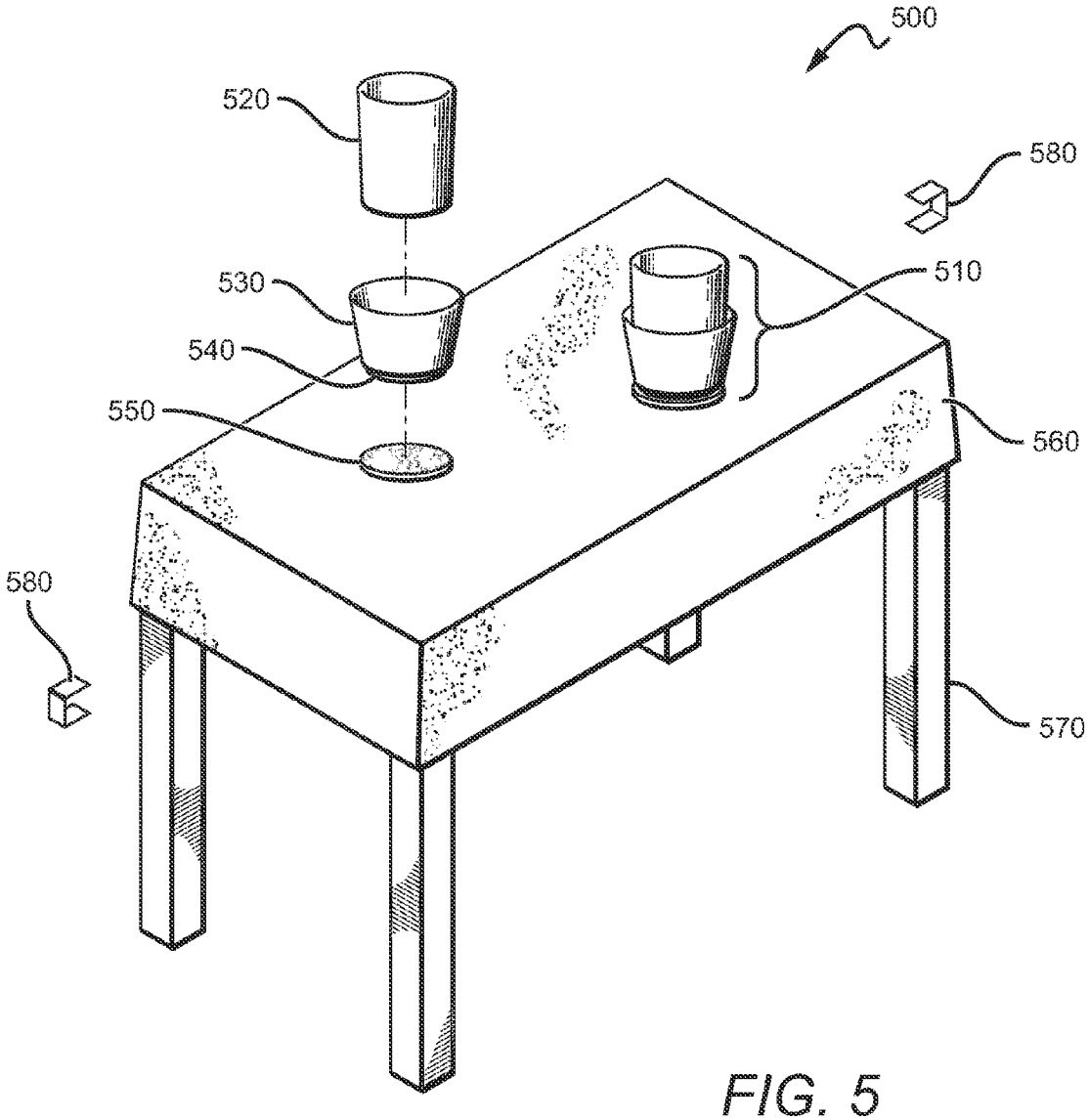
FIG. 5 is a flow chart of a method of using a tableware holder of the present invention.

FIG. 1 shows a tableware holder 100 with a stabilizer 110. While tableware holder 100 is sized and dimensioned to hold a flat plate, the dimensions of tableware holder 100 could be altered to hold a cup, napkins, or even utensils (by extending stabilizer 110 across the entire top surface of the tableware holder so that a utensil could be tucked underneath the stabilizer). A piece of tableware, such as a paper plate (not shown), could fit into recess 120 under stabilizer 110, which prevents the paper plate from blowing upwards out of the tableware holder 100. While stabilizer 110 is shown as a tab that is oriented substantially horizontally and is disposed about an inner edge of tableware holder 100 along with other tabs, the stabilizer could be placed orientated at an upward angle or could be disposed along the outer edge of the tableware holder. Multiple stabilizers could be used to prevent the piece of tableware from moving in multiple directions. For example, a stabilizer could be used to prevent the piece of tableware from blowing upwards, and another stabilizer could be used to prevent the piece of tableware from blowing to the side. Preferably, enough stabilizers are positioned around a piece of tableware to prevent the piece of tableware from moving in at least three or four different directions.

A first fastener (not shown) is affixed to the underside of tableware holder 100 to help fasten the tableware holder against a table cover. While first fastener is a hook and loop fastener, commonly referred to in the art as a Velcro™ fastener, any suitable commercially available fastener could be used, for example adhesives, magnets, snap buttons, and matching sockets. Preferably, the fasteners are engaged through contact and some pressure, and are disengaged by pulling the fasteners away from one another in a certain direction. Exemplary fasteners could be both engaged and disengaged from one another in at least 20, 10, and or even 2 seconds. It is contemplated that the bond strength of the mating fasteners can be designed to withstand forces from average wind speeds, vibrations during a turbulent air flight, or the swaying and bouncing from a boat.

Unless a contrary intent is apparent from the context, all ranges recited herein are inclusive of their endpoints, and open-ended ranges should be interpreted to include only commercially practical values.

Tableware holder 100 is preferably made of a plastic material and is at least 1-2 pounds in weight, although other materials and weights could be used without departing from the scope of the current invention. Tableware holder 100 also shows a series of slits extending from the center of the tableware holder and radiating out towards the circumference of the tableware holder. These slits not only provide aesthetic appeal to the tableware holder, but also save on plastic and enhance moldability since there would be less bubbling during manufacture of a plastic tableware holder with multiple slits. Other designs could be made from the mold of tableware holder 100 to save on plastic and to improve the moldability of tableware holder 100.

In FIG. 2A, tableware holder 200 has a circular wall 210, which acts a stabilizer to receive a cup. Circular wall 210 is shown as a contiguous wall of a constant height, but could have interposed slits and an uneven wall to save on plastic. FIG. 2A also shows a hook fastener 220 on a bottom of tableware holder 200, which mates with a loop fastener on a table cover to temporarily hold the tableware holder to the table cover. Hook fasteners are preferably at least 1 inch, 2 inches, 3 inches, or even 4 inches across so as to provide a large surface area. Exemplary hook fasteners cover the entire bottom surface of the tableware holder to provide the largest possible surface area to fasten to. While hook fastener 220 is circular, hook fasteners could be shaped in other configurations without departing from the scope of the current invention.

An alternative tableware holder 250 is shown in FIG. 2B, with upper recess 260, and bottom recess 270. Tableware holder 250 is also shaped to receive a cup (not shown), but has an inner lower edge and an outer lower edge that define bottom recess 270 that surrounds upper recess 260. An ice pack 280 could then be placed within bottom recess 270 to chill a cup (not shown) in the upper recess. Bottom recess 270 could have stabilizers (not shown) that hold ice pack 280 in place, for example by having a bottom lid that snaps in place over bottom recess 270.

FIG. 3 shows a tableware holder 300 which can be used to secure a utensil, for example a fork, spoon, knife, or chopsticks to a table cover (not shown). Tab 310 of FIG. 3 hangs over the space where an eating utensil is placed and prevents the utensil from moving. The bottom of tableware holder 300 has a hook fastener 330 which can mate to a loop fastener on a table cover (not shown). While tableware holders 100, 200, and 300 are shown as three separate components that are sized and dimensioned to hold different types of tableware, and are preferably three separate components, all could be integrated into a single tray without departing from the scope of the invention. For example, FIG. 4 shows an tableware holder 400 with a first recess 410 for a paper plate and a second recess 420 for a paper cup.

FIG. 5 shows a tableware holder system 500 with cup 520, tableware holder 530, and table cover 560. Here, a cup 520 is placed within tableware holder 530 which has fastener 540. Fastener 540 mates with fastener 550, which is permanently attached to table cover 560. Fasteners 540 and 550 then mate together via tiny hooks and loops and can be easily attached and detached while providing a strong enough connection to resist outside winds. While fastener 550 is shown as a small subsection of table cover 560, fastener 550 could cover a greater area of table cover 460, and, preferably, fastener 550 composes the entirety of table cover 560. In-use cup holder 510 shows how cup 520, tableware holder 530, and table cover 560 all couple together to cooperatively prevent cup 520 from blowing away in the wind.

Table cover 560 covers a surface of table 570, and could optionally be coupled to table 570 with clamps 580 that could be used to squeeze the table cover against the top of the table. While clamps 580 are shown as metal brackets that wrap above and below the surface of the table, the clamps could have attached springs to allow them to clamp to a variety of table thicknesses. A variety of other methods could be used to couple the table cover to the surface of the table, for example the corners of table cover 560 could have string (not shown) that wrap around the table legs and could be tied to one another. Alternatively, the table cover could have a series of button fasteners that snap into mating button fasteners adhesively coupled to the table surface. All commercially available fasteners are contemplated for use in coupling the table cover to the table. Smaller table covers preferably have some sort of fastening mechanism to prevent the table cover itself from blowing away during high winds or other inclement outdoor weather. It is contemplated that a table cover could be made of any commercially suitable material, for example such as cloth, plastic, or paper, but is preferably made out of a thermoplastic polymer.

FIG. 6 shows the steps that are generally taken to secure tableware to a table cover using a tableware holder-table cover pair of the present invention. First, the tableware holder and the table cover are provided to a user, generally by a store or a party planner. Next, the table cover is placed on a table and is preferably coupled to the table using weights or fasteners. The container is then placed within the tableware holder and is secured to the table holder with one or more stabilizers. Lastly, the tableware holder is then affixed to the table cover using mating fasteners.

Preferably, the table cover and the tableware holder are packaged and sold to the public in a single kit. However, the table cover and the tableware holders could be packaged separately and could be offered as optional components of a container-immobilizing solution under a common brand name or product line. These related table covers and tableware holders are preferably sold in the same section in a store, no more than 1, 2, or 3 meters apart from one another. Preferably the container-holders and table covers are commercially available to individual users, but could also be provided as part of a larger service, for example a catering service that supplies picnic materials.

Thus, specific compositions and methods of the inventive subject matter have been disclosed. It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A system for holding a piece of tableware in place on a surface, comprising:

a tableware holder having a stabilizer sized and disposed to receive the piece of tableware and having a first fastener;

a table cover sized and disposed to cover an entire upper surface of a table, wherein the table cover has a second fastener that mates with the first fastener and has a third fastener that couples the table cover to the table; and wherein the stabilizer comprises a tab that restricts a movement of the piece of tableware in a direction.

2. The system of claim 1, wherein the stabilizer composes a wall that surrounds the piece of tableware.

3. The system of claim 2, wherein the wall is circular.

4. The system of claim 1, further comprising a second tableware holder sized and disposed to receive a second piece of tableware and having a fourth fastener, wherein the table cover has a fifth fastener that mates with the fourth fastener.

5. The system of claim 1, wherein the tableware holder comprises a material with a specific heat of at least 2 Joules per gram.

6. The system of claim 1, wherein the tableware holder comprises an insulating material.

7. The system of claim 1, wherein the table cover comprises a cloth material.

8. The system of claim 1, wherein the third fastener comprises a clamp that compresses the table cover against the table.

9. The system of claim 1, wherein the first fastener comprises hooks and the second fastener comprises loops.

10. The system of claim 1, further comprising a sales kit that holds the tableware holder and the table cover.

11. A method of securing a container to a table, comprising steps of:

providing a tableware holder with a first fastener;

providing a table cover with a second fastener that mates with the first fastener;

covering an entire upper surface of the table with the table cover;

coupling the table cover to the table;

mating the first fastener with the second fastener; and disposing the container within the tableware holder by disposing a portion of the container behind a tab.

12. The method of claim 11, further comprising providing the tableware holder and the table cover in a single kit.

13. The method of claim 11, further comprising providing a fastener to couple the table cover to the table.

14. The method of claim 11, wherein coupling the table cover to the table comprises tying the table cover to at least two legs of the table.

15. The method of claim 11, wherein the step of coupling the first fastener with the second fastener comprises pressing the first fastener against the second fastener.

16. The method of claim 11, further comprising lowering a temperature of a portion of the tableware holder.

* * * * *